US005228323A

United States Patent [19]

Dubinsky et al.

[11] Patent Number: 5,228,323

[45] Date of Patent: Jul. 20, 1993

[54] FLARING TOOL

[75] Inventors: Miles Dubinsky, Carol Stream; Rinart Joseph, Norridge, both of Ill.

[73] Assignee: The Pullman Company, Livingston, N.J.

[21] Appl. No.: 773,143

[22] Filed: Oct. 8, 1991

[51] Int. Cl.[5] ..... B21D 41/02

[52] U.S. Cl. ..... 72/317; 72/116; 269/279; 403/96

[58] Field of Search ..... 72/317, 116, 125; 269/249, 246, 215, 284, 279; 403/96, 93

[56] References Cited

U.S. PATENT DOCUMENTS

| | | | |
|---|---|---|---|
| 1,858,849 | 5/1932 | Borden | 269/279 |
| 2,450,994 | 10/1948 | Schaefer | 269/249 |
| 2,505,666 | 4/1950 | Franck | 269/279 |
| 2,534,510 | 12/1950 | Franck | 72/116 |
| 2,843,924 | 7/1958 | Franck | 72/317 |
| 4,133,519 | 1/1979 | Shin | 269/279 |

*Primary Examiner*—Daniel C. Crane
*Attorney, Agent, or Firm*—John G. Gilfillan, III

[57] ABSTRACT

An improved flaring tool includes the usual plurality of expandable die blocks retained by a U-shaped frame. A clamping screw is treaded through a clamp block which is rotatably mounted between the legs of the frame at its open end. The screw is movable toward and away from the die blocks to clamp or unclamp tubing between adjacent die blocks. A conical flaring tip is movable against the end of a clamped tubing for flaring same. The clamp block's axis of rotation is perpendicular to the direction of movement of the die blocks and the screw. The improvement comprises a facility which locks the clamp block against rotation when the screw is aligned with the die block and their direction of movement. The locking facility prevents unintentional rotation of the clamp block as the screw is rotated to clamp or unclamp the tubing, but may be manually overcome to intentionally rotate the clamp block.

8 Claims, 2 Drawing Sheets

EXPANDED

FLARING TOOL

BACKGROUND OF THE INVENTION

The present invention relates to an improved flaring tool, and, more particularly, to an improved tube or pipe flaring tool the manual operation of which is more convenient than is the operation of prior art flaring tools.

A typical flaring tool comprises a plurality of adjacent, facing and separable die blocks. Adjacent blocks each contain one-half of one or two circular cross-section passageways. Each passageway half ends at a diameter of its cross-section. When adjacent blocks are held together, the now complete passageways define forming dies. Each passageway or forming die may be flared or diametrically enlarged at one end. A conical member is progressively movable into and against a metal tube or pipe held and gripped in the complete passageway in the vicinity of the die flare to flare outwardly the tube between the conical member and the die flare. To aid in holding the tube during flaring, the walls of the complete passageways may contain circumferential or helical grooves.

The diameters of the complete passageways vary to permit the flaring of tubes having varying OD's. Each diameter is slightly less than the OD of its related tube, so that a tube placed between adjacent blocks when they are separated or expanded will be firmly gripped and held when the passageway is completed by moving and holding the blocks together. After the tube is flared, the blocks must be re-separated or re-expanded to permit the tube and its now increased diameter flare to be removed from between the die blocks.

In one type of prior art device, a line of die blocks slide together and apart radially (or diametrically), that is, along a radius (or diameter) of the passageways and the passageway halves. The die blocks are constrained to so slide by a U-shaped member or strap. The strap fits into complementary relieved areas formed in outside opposed die block walls which are parallel to the direction of block movement. Thus, die block movement is transverse to the major axes of the passageways and of the passageway halves. The passageways are completed and the die blocks are clamped together by exerting a clamping force on the terminal die block at one end of the line of blocks to move the die block at the other end of the line against the bridge of the U. The clamping force may be exerted by a clamping member, such the end of as a screw threaded into and retained by a clamp block held between the legs of the U at its open end. Moving the screw end away from the line of blocks, permits the blocks to expand or move apart so as to facilitate placement or removal of a tube into or from a passageway.

In one type of prior art flaring tool, the clamp block is rotatable between the legs of the U. This, in theory, obviated the need to move the screw member away from the line of blocks the distance necessary to permit sufficient expansion of the blocks for tube placement or removal. Specifically, limited movement of the screw end away from the die blocks thereafter permitted rotation of the clamp block and the retained screw to entirely remove the screw from the path of sliding movement of the blocks, thus permitting free expansion of the blocks. In practice, this arrangement requires a user to manually hold the screw or clamp block to maintain the screw in alignment with the path of movement of the die blocks during both clamping and unclamping. Manually maintaining such alignment during unclamping is necessary to permit controlled removal of a now flared tube. Uncontrolled and/or rapid rotation of the clamp block and screw away from the die block movement path permits the blocks to uncontrollably and/or rapidly expand. This may result in the tube falling out of its expanded passageway and onto a floor or work surface, possibly damaging or nicking the flare. Manually maintaining the alignment of the screw with the block movement path during clamping prevents the increasing force between the screw and the terminal block from inadvertently causing the block and the screw to rotate and unclamp the die blocks.

SUMMARY OF THE INVENTION

An improved flaring tool has the structure generally set forth above and also includes facilities which selectively lock the clamp block against rotation and in a position wherein the clamping element or screw lies on the sliding path of the die blocks. The locking force on the block may be manually overcome to permit rotation of the clamping element out of the die block path of sliding movement. The locking force on the block is sufficient to resist rotation of the clamp block as the clamping element clamps the die blocks together and, absent being manually overcome, as the clamping element unclamps the die blocks.

DETAILED DESCRIPTION

Figure 1:
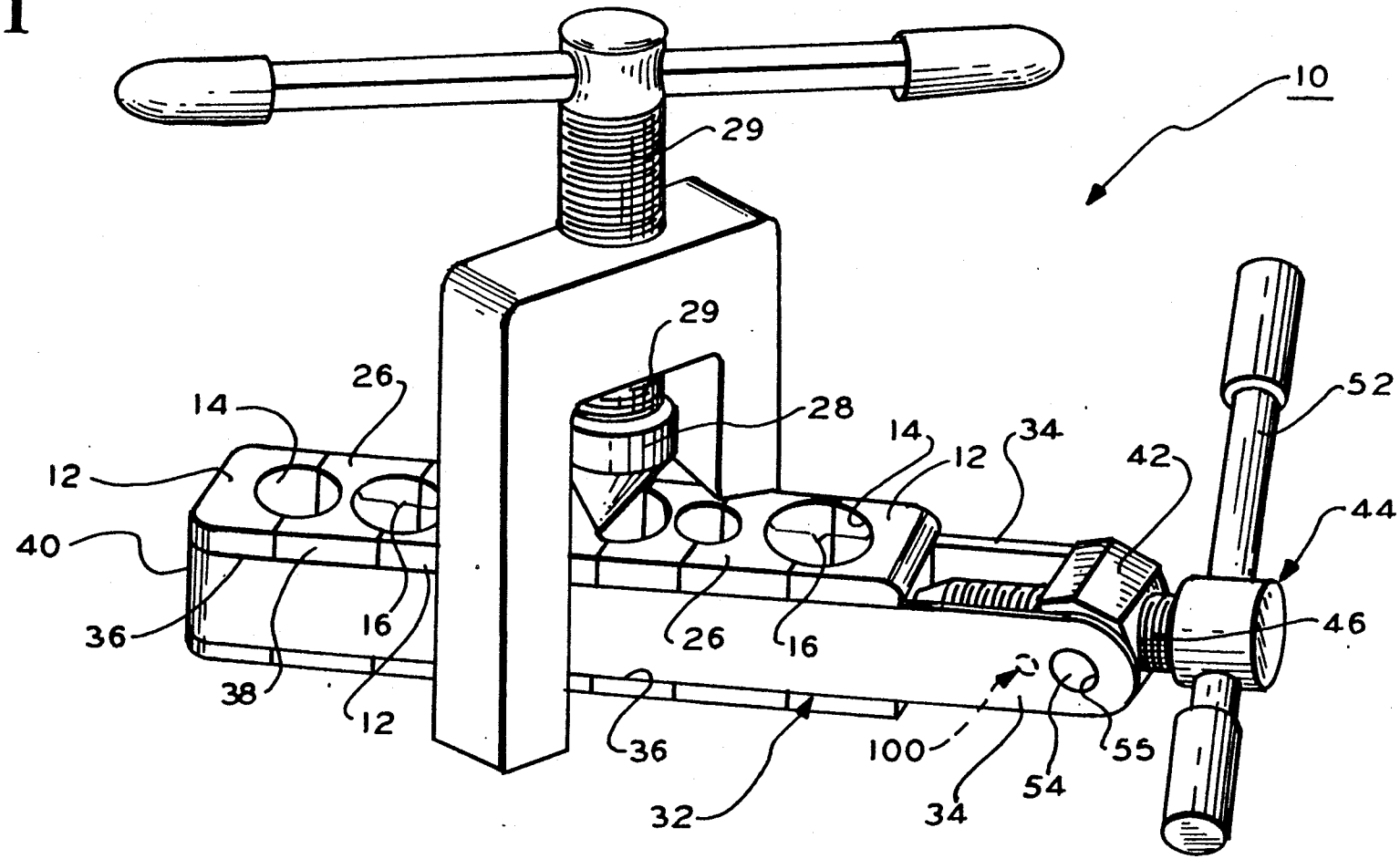
FIG. 1 is a perspective view of the flaring tool according to the present invention.
Figure 2:
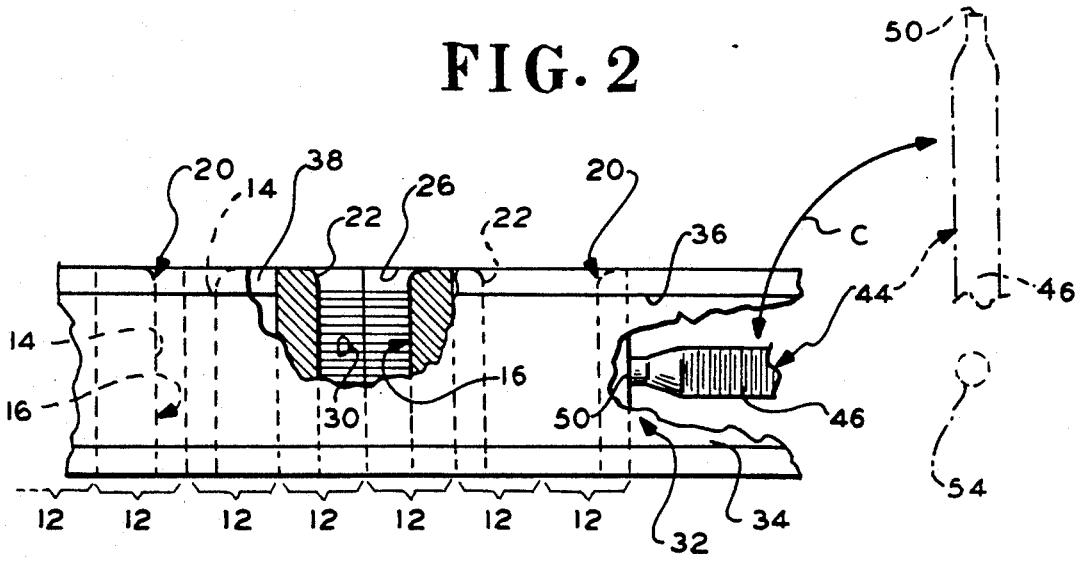
FIG. 2 is a side elevation of a portion of the flaring tool of FIG. 1.
Figure 4:
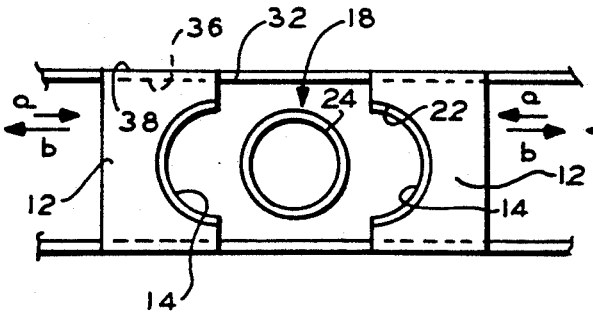
FIGS. 4 and 5 are generalized views showing the use of the tool of FIGS. 1–3.
Figure 5:
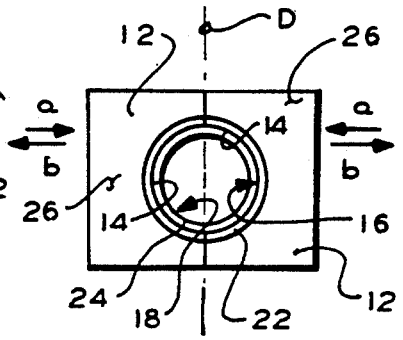

Referring to FIG. 1, there is shown a flaring tool 10 according to the present invention. The flaring tool 10 includes a side-by-side series of die blocks 12 adjacent ones of which contain one-half 14 of a completed die passageway 16 which is formed when the adjacent die blocks 12 are held together (FIGS. 1, 2 and 5). The die blocks 12 are movable together (arrows a in FIGS. 4 and 5) to form the completed passageways 16, and apart (arrows b in FIGS. 4 and 5) into an expanded state wherein adjacent die blocks 12 are separated, as are the passageway halves 14. As shown (FIG. 5), the passageway halves 14 terminate on a diameter D of their respective passageways 16, which have circular cross sections.

When adjacent die blocks 12 are expanded or separated (FIG. 4), a tube 18 may be located therebetween in axial alignment with the passageway halves 14. Subsequent movement together (FIG. 5) of the die blocks 12 traps and holds the tube 18 in the now completed passageway 16. Re-expansion (FIG. 4) of the die blocks 12 permits removal of the tube 18 from between the die blocks 12.

One terminus 20 of each die passageway half 14, as well as the completed passageway 16 is formed into flared die or forming surface 22 (FIGS. 2, 4 and 5) having a selected contour and a selected simple or compound radius. With the tube 18 held in the completed passageway 16 so that its terminus 24 is coplanar with the adjoining surfaces 26 of the adjacent, held together, die blocks 12, a conical tip 28 on a threaded screw 29 may be progressively moved into the tube 18 at the terminus 24 to form the terminus 24 between itself and the die surface 22, thereby flaring the tube 18. To aid in holding the tube 18 during flaring, the tube may be gripped by circumferential or helical ribs or grooves 30 formed in the passageway 16 (FIG. 2). The ID of the completed passageway 16 is a selected amount smaller than the OD of the tube 18 to stabilize the tube 18 during flaring.

A U-shaped strap 32, or other facility, holds and constrains the die blocks 12 in alignment for movement together or apart (during expansion) along a line or path of movement which is transverse to the axes of the passageway halves 14 and the completed passageways 16. Constrainment may be achieved by opposed, parallel legs 34 of the strap 32 complementarily fitting into relieved portions or depressions 36 formed in opposed surfaces 38 of the die blocks 12. The legs 34 of the strap 32 are joined by a bridge 40 which closes the U, the U being open at the free ends of the legs 34 distally of the bridge 40.

The tool 10 also includes a clamp block 42 rotatably mounted and between the free ends of the legs 34. The clamp block 42 mounts a clamp member 44, such as a threaded member or screw 46 via a threaded bore 48. Rotation of the screw 46 in the bore 48 moves its end 50 toward and away from the line of die blocks 12 held in the strap 32. When the screw end 50 is moved sufficiently toward the blocks 12, they are moved and clamped together against and between the bridge 40 and the screw end 50. When the screw end 50 is moved away from the blocks 12, they are free to expand for insertion or removal of the tube 18. The screw 46 may mount a transverse lever arm 52 by which it is turned and which provides sufficient mechanical advantage to tightly clamp together the die blocks 12.

The clamp block 42 is rotatably mounted to the legs 34, by stub shafts 54 integral with the block 42 and rotatably held in holes 55 formed in the legs 34, for rotation about the axis of the shaft 54 which is perpendicular to the path of movement of the die blocks 12. Rotation of the clamp block 42 as shown by arrow C in FIG. 2 rotates the screw 46 about the same axis.

Rotation of the clamp block 42 and the screw 46 (arrow C in FIG. 2) limits the extent to which the screw 46 must be rotated in the block 42 to clamp or unclamp the line of die blocks 12. Specifically, with the screw 46 rotated sufficiently via the arm 52 to tightly clamp together the die blocks 12 to positively complete the passageways 16 and to clamp in selected ones thereof tubes 18, the tubes 18 may be flared. Thereafter, limited rotation of the screw 46 away from the die blocks 12 permits partial expansion the blocks 12. Full expansion of the die blocks 12 may thereafter occur by rotating the clamp block 42 and its screw 46 (arrow C) to remove the screw end 50 from the movement path of the die blocks 12. Subsequent reverse rotation of the clamp block 42 and the screw (arrow C) and limited reverse rotation of the screw 46 in the bore 48 reclamps the die blocks 12 and any tubes 18 located in the passageways 16. Without the clamp block 42 and its screw 46 being rotatable, the screw 46 would have to be rotated and moved a much greater amount to achieve clamping and unclamping.

Free rotatability of the clamp block 42 and its screw 46 in prior art devices has led to disadvantages. Specifically, during clamping, and absent manual restraint of the clamp block 42, non-normal forces between the axis of the screw 46 and its end 50, on the one hand, and the die block 12 against which the end 50 acts, can cause rotation of the clamp block 42 which undesirably (and possibly uncontrollably) releases a soon-to-be clamped tube 18. The foregoing requires replacement and reclamping of the tube 18, a waste of time and effort.

Similarly, during unclamping of the die blocks 12 following flaring of a tube 18, unclamping rotation of the clamp block 42 and its screw 46 could, absent manually restraining the clamp block 42 and its screw 46, permit their rotation so that the blocks 12 freely expand and release the flared tube 18. This can, in turn, lead to the flared tube 18 falling onto a floor or work surface thereby damaging, deforming or scarring the precisely formed flare.

Figure 3:
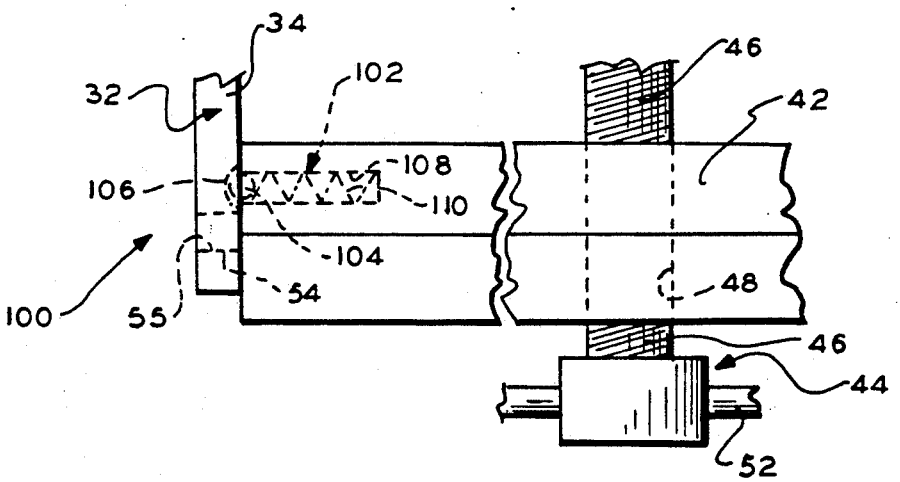
FIG. 3 is an exploded top view of a portion of the flaring tool of FIGS. 1 and 2, illustrating certain inventive features thereof.

In the tool 10 of the present invention, facilities 100 are provided to prevent the foregoing disadvantages. The facilities 100 selectively lock the clamp block 42 in a rotational position wherein the axis of the screw 46 and its end 50 are aligned with the movement path of the die blocks 12 (FIGS. 2 and 3). The facilities 100 permit nominal manual force, acting on and enhanced by the lever arm 52 and/or the portion of the screw 46 extending beyond the clamp block 42, to overcome the locking force on the clamp block 42 so that the block 42 and its screw 46 can be selectively rotated as above described. The locking force of the facilities 100 is sufficiently high to prevent both inadvertent rotation of the clamp block 42 during clamping or unclamping movement of its screw 46 and rotation of the block 42 due to non-normal forces on the screw end 50 during clamping.

The facilities 100 may include a spring-biased detent 102 which includes a ball 104 urgable into a recess 106 formed in one leg 34. The ball 104 rides and slides in a blind aperture 108 formed in the block 42. A compression spring 110 acts between the aperture 108 and the ball 104 to force the ball 104 into the recess 106 to lock the clamp block 42 in its selected position.

The relative sizes of the ball 104 and the recess 106 and the strength of the spring 110 are selected so that the clamp black 42 is locked in a rotational position wherein the screw end 50 is held in alignment with the path of movement of the block 12. This alignment is maintained during the times during which the blocks 12 are being clamped together and are being unclamped. A positive rotational force on the clamp block 42 due to application of a torque on the clamp member 44 permits the block to rotate as the ball 104 is moved off the recess 106.

What is claimed is:

1. An improved flaring tool of the type having a plurality of expandable die blocks held by a U-shaped member in alignment for relative sliding; a clamp block mounted between the legs of the member at the open end of the U; and a clamping element movable through the clamp block (i) in a first direction toward the die blocks and the bridge of the U to clamp the die blocks together between itself and the bridge and (ii) in a second direction away from the die blocks to permit the die blocks to expand, said flaring tool having means mounted on said U-shaped member for flaring a workpiece clamped between said die blocks; wherein the improvement comprises:

means for mounting the clamp block for rotation on an axis perpendicular to the legs of the U and to the first and second directions, so that following a limited amount of movement of the clamping element in the second direction away from the clamped die blocks, the clamp block is rotatable to rotate the clamping element out of the sliding path of the die blocks, and means for selectively locking the clamp block against rotation in either direction in a rotatable position wherein the clamping element lies on the sliding path of the die blocks, the clamp block being manually rotatable against the action of the locking means to rotate the clamping element out of the sliding path of the die blocks, the locking means locking the clamp block with sufficient force parallel to the axis to resist rotation of the clamp block as the clamping element clamps the die blocks together.

2. An improved flaring tool of the type having a plurality of expandable die blocks held in alignment by a U-shaped member for relative sliding along first and second parallel directions; a clamp block mounted between the legs of the member at the open end of the U; and a clamping element which is movable through the clamp block and against and away from a terminal die block (i) in the first direction toward the die blocks and the bridge of the U to clamp the die blocks together between the element and the bridge and (ii) in the second direction away from the die blocks and the bridge to permit the die blocks to expand, said flaring tool having means mounted on said U-shaped member for flaring a workpiece clamped between said die blocks; wherein the improvement comprises:

means for mounting the clamp block for rotation on an axis which is perpendicular to the first and second directions and to the legs of the U so that, following a limited amount of movement of the clamping block in the second direction away from the clamped die blocks, the clamp is rotatable about the axis to rotate the clamping element out of the path of sliding of the die blocks in the second direction, and means which selectively exerts force on the clamp block in a third direction parallel to the axis for selectively locking the clamp block against rotation in either direction out of a rotatable position whereat the clamping element is parallel to the first and second directions and lies on the sliding path of the die blocks, the clamp block being manually rotatable against the action of the locking means after movement of the clamping element in the second direction to rotate the clamping element out of the sliding path of the die blocks, the locking means locking the clamp block with sufficient force to resist rotation of the clamp block produced by the production of forces between the clamp block and the terminal die block as the clamping element moves in the first direction to clamp the die blocks together and to resist rotation of the clamp block permitted by the decrease of forces between the clamp block and the terminal die block as the clamping element moves in the second direction to permit the die blocks to expand.

3. An improved flaring tool as in claim 2, wherein: the locking means includes a recess formed in one leg of the U, and a spring-biased detent carried by the clamp block, the detent falling into the recess when the clamping element lies on the sliding path of the die blocks.

4. An improved flaring tool as in claim 3, wherein: the detent includes a blind bore in the clamp block, a ball movable in the bore, and a compression spring acting between the ball and the bore.

5. An improved flaring tool as in claim 2, wherein: the clamp block includes a threaded bore extending transversely of the axis of rotation of the block, and the clamping element is a threaded member held in the threaded bore and selectively rotatable to move the clamping element in the first and second directions.

6. An improved flaring tool as in claim 5, wherein: the axis of the threaded bore intersects the axis of rotation of the block.

7. An improved flaring tool as in claim 6, wherein: the locking means includes a recess formed in one leg of the U, and a spring-biased detent carried by the clamp block, the detent falling into the recess when the clamping element lies on the sliding path of the die blocks.

8. An improved flaring tool as in claim 7, wherein: the detent includes a blind bore in the clamp block, a ball movable in the bore, and a compression spring acting between the ball and the bore.

* * * * *